US010884365B2

(12) United States Patent
Shimada

(10) Patent No.: US 10,884,365 B2
(45) Date of Patent: Jan. 5, 2021

(54) FIXING DEVICE AND IMAGE FORMING APPARATUS INCORPORATING SAME

(71) Applicant: Hiroyuki Shimada, Tokyo (JP)

(72) Inventor: Hiroyuki Shimada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/736,876

(22) Filed: Jan. 8, 2020

(65) Prior Publication Data

US 2020/0278627 A1 Sep. 3, 2020

(30) Foreign Application Priority Data

Feb. 28, 2019 (JP) ..... 2019-036480

(51) Int. Cl.
*G03G 15/20* (2006.01)

(52) U.S. Cl.
CPC ..... *G03G 15/2053* (2013.01); *G03G 15/2064* (2013.01); *G03G 2215/2029* (2013.01); *G03G 2215/2035* (2013.01)

(58) Field of Classification Search
CPC ..... G03G 15/2053; G03G 15/2064; G03G 2215/2029; G03G 2215/2035
See application file for complete search history.

(56) References Cited

U.S. PATENT DOCUMENTS

2011/0236088 A1* 9/2011 Maruyama ..... G03G 15/2064 399/329
2013/0177340 A1* 7/2013 Kawata ..... G03G 15/2064 399/329
2013/0279955 A1* 10/2013 Maeda ..... G03G 15/2053 399/329
2015/0055994 A1 2/2015 Shoji et al.
2015/0093165 A1* 4/2015 Kondo ..... G03G 15/2053 399/329

(Continued)

FOREIGN PATENT DOCUMENTS

JP 2010-032625 2/2010
JP 2015-043075 3/2015

(Continued)

OTHER PUBLICATIONS

U.S. Appl. No. 16/419,068, filed May 22, 2019, Ippei Fujimoto, et al.

*Primary Examiner* — Ryan D Walsh
(74) *Attorney, Agent, or Firm* — Oblon, McClelland, Maier & Neustadt, L.L.P.

(57) ABSTRACT

A fixing device includes an endless fixing rotator, a heater, a nip formation pad, and a pressure rotator. The heater is disposed opposite an inner circumferential surface of the fixing rotator to heat the fixing rotator. The nip formation pad is disposed opposite the inner circumferential surface of the fixing rotator that is slidable over the nip formation pad. The pressure rotator is configured to press against the nip formation pad via the fixing rotator to form a fixing nip through which a recording medium bearing a toner image is conveyed while being sandwiched between the fixing rotator and the pressure rotator. The nip formation pad includes a base and a thermal equalizer having a thermal conductivity higher than a thermal conductivity of the base. The nip formation pad has a nip face opposite the fixing nip. The thermal equalizer is disposed in at least part of the nip face.

9 Claims, 6 Drawing Sheets

(56) References Cited

U.S. PATENT DOCUMENTS

| | | | | |
|---|---|---|---|---|
| 2016/0274514 | A1 | 9/2016 | Ishii et al. | |
| 2016/0378027 | A1* | 12/2016 | Sawada | G03G 15/2053 399/329 |
| 2017/0102651 | A1* | 4/2017 | Tanaka | G03G 15/2039 |
| 2017/0176899 | A1 | 6/2017 | Okamoto et al. | |
| 2017/0185009 | A1 | 6/2017 | Yoshinaga et al. | |
| 2017/0255147 | A1* | 9/2017 | Seki | G03G 15/2053 |
| 2017/0255149 | A1* | 9/2017 | Takagi | G03G 15/2053 |
| 2018/0059587 | A1 | 3/2018 | Sawada et al. | |
| 2018/0157198 | A1* | 6/2018 | Seto | G03G 15/2053 |
| 2018/0173138 | A1 | 6/2018 | Seki et al. | |
| 2018/0284669 | A1 | 10/2018 | Fujimoto et al. | |
| 2019/0235422 | A1* | 8/2019 | Yabuki | G03G 15/2053 |
| 2019/0286025 | A1 | 9/2019 | Yamaguchi et al. | |

FOREIGN PATENT DOCUMENTS

| | | |
|---|---|---|
| JP | 2015-064561 | 4/2015 |
| JP | 2016-173559 | 9/2016 |
| JP | 2017-072780 | 4/2017 |
| JP | 2017-120391 | 7/2017 |

* cited by examiner

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2019-036480, filed on Feb. 28, 2019, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image onto a recording medium and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator.

In recent years, such image forming apparatuses are demanded for energy efficiency and high-speed processing. In particular, a high-speed startup of the fixing device, that is, a shortened period of time to start up the fixing device is demanded to shorten a standby time for a user of the image forming apparatus.

SUMMARY

In one embodiment of the present disclosure, a novel fixing device includes an endless fixing rotator, a heater, a nip formation pad, and a pressure rotator. The heater is disposed opposite an inner circumferential surface of the fixing rotator to heat the fixing rotator. The nip formation pad is disposed opposite the inner circumferential surface of the fixing rotator that is slidable over the nip formation pad. The pressure rotator is configured to press against the nip formation pad via the fixing rotator to form a fixing nip through which a recording medium bearing a toner image is conveyed while being sandwiched between the fixing rotator and the pressure rotator. The nip formation pad includes a base and a thermal equalizer having a thermal conductivity higher than a thermal conductivity of the base. The nip formation pad has a nip face opposite the fixing nip. The thermal equalizer is disposed in at least part of the nip face.

Also described is a novel image forming apparatus incorporating the fixing device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
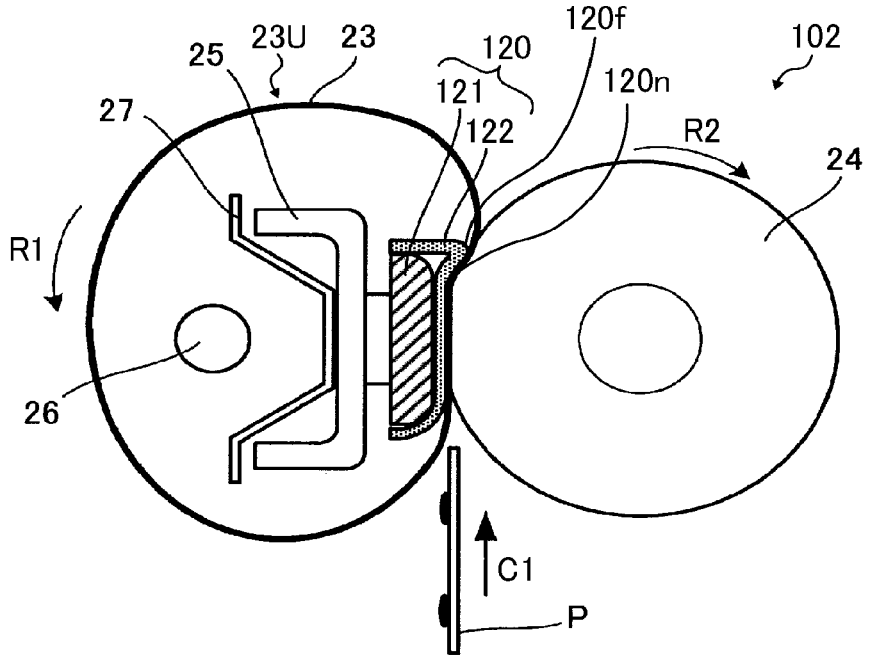
FIG. 1 is a cross-sectional view of a comparative fixing device.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and K denote colors of yellow, cyan, magenta, and black, respectively. To simplify the description, these suffixes are omitted unless necessary.

Referring to the drawings, wherein like reference numerals designate identical or corresponding parts throughout the several views, embodiments of the present disclosure are described below.

Figure 2A:
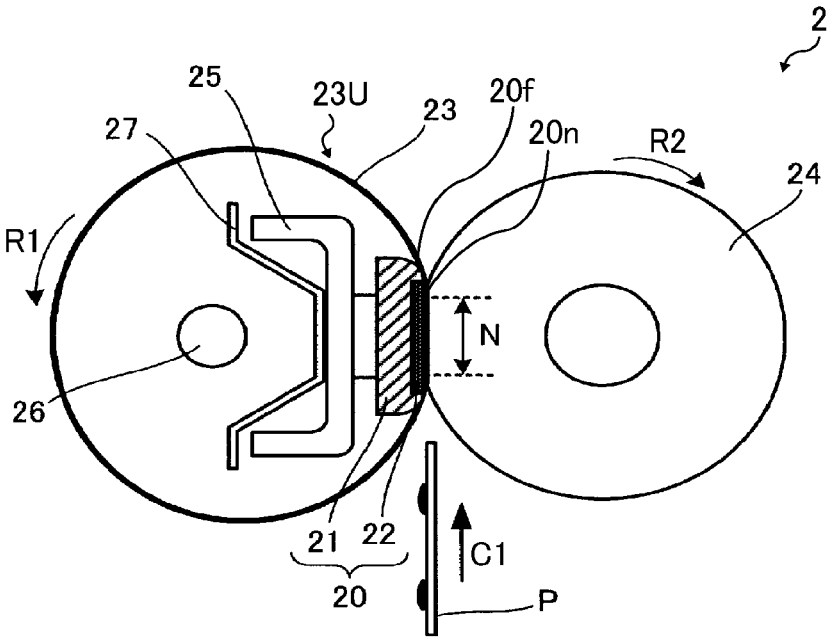
FIG. 2A is a cross-sectional view of a fixing device according to an embodiment of the present disclosure, particularly illustrating a first example of a nip formation pad.
Figure 2B:
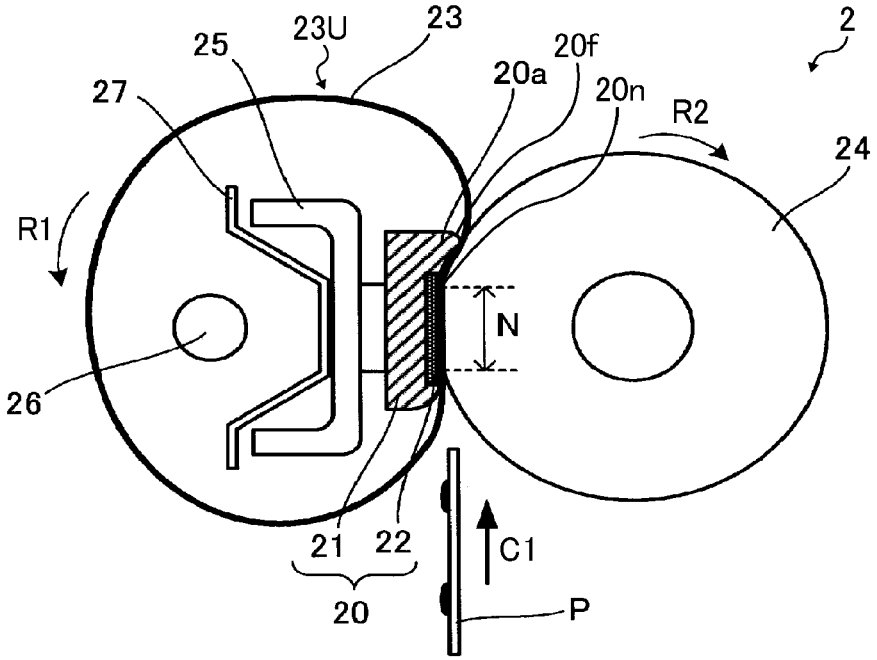
FIG. 2B is another cross-sectional view of the fixing device, particularly illustrating a second example of the nip formation pad.

Initially with reference to FIGS. 1 to 2B, a description is given of fixing devices.

FIG. 1 is a cross-sectional view of a comparative fixing device 102. FIG. 2A is a cross-sectional view of a fixing device 2 according to an embodiment of the present disclosure, particularly illustrating a first example of a nip formation pad 20. FIG. 2B is another cross-sectional view of the fixing device 2, particularly illustrating a second example of the nip formation pad 20.

As illustrated in FIGS. 1 to 2B, each of the comparative fixing device 102 and the fixing device 2 (e.g., a fuser or a fusing unit) includes a fixing belt 23 as an endless belt formed into a loop, a pressure roller 24, and various components disposed inside the loop formed by the fixing belt 23, such as a comparative nip formation pad 120 (for the comparative fixing device 102) or the nip formation pad 20 (for the fixing device 2), a stay 25, a heater 26, and a reflector 27. The fixing belt 23 and the components disposed inside the loop formed by the fixing belt 23 constitute a belt unit 23U, which is detachably coupled to the pressure roller 24. The fixing belt 23 is an endless fixing rotator rotatable in a counterclockwise direction of rotation R1 in FIGS. 1 to 2B. The pressure roller 24 is a pressure rotator disposed opposite an outer circumferential surface of the fixing belt 23 and rotatable in a clockwise direction of rotation R2 in FIGS. 1 to 2B. The fixing belt 23 is directly heated with radiation heat or light from the halogen heater 26, from an inside of the loop formed by the fixing belt 23.

As illustrated in FIGS. 1 to 2B, each of the comparative nip formation pad 120 and the nip formation pad 20 is disposed inside the loop formed by the fixing belt 23 and opposite the pressure roller 24 via the fixing belt 23. In other words, each of the comparative nip formation pad 120 and the nip formation pad 20 is disposed opposite an inner circumferential surface of the fixing belt 23 to form an area of contact, herein referred to as a fixing nip N, between the fixing belt 23 and the pressure roller 24. As the fixing belt 23 rotates in the direction of rotation R1, the fixing belt 23 slides over the comparative nip formation pad 120 in FIG. 1 and the nip formation pad 20 in FIGS. 2A and 2B. That is, the inner circumferential surface of the fixing belt 23 is slidable over the comparative nip formation pad 120 in FIG. 1 and the nip formation pad 20 in FIGS. 2A and 2B, directly or indirectly. A toner image is fixed onto a recording medium P under heat and pressure at the fixing nip N while the recording medium P bearing the toner image is sandwiched between the fixing belt 23 and the pressure roller 24 and conveyed through the fixing nip N in a direction of conveyance of the recording medium P (hereinafter referred to as a recording medium conveying direction C1).

The fixing belt 23 rotates in accordance with rotation of the pressure roller 24. For example, as a driver drives and rotates the pressure roller 24, a driving force of the driver is transmitted from the pressure roller 24 to the fixing belt 23 through the fixing nip N, thus rotating the fixing belt 23 by friction between the pressure roller 24 and the fixing belt 23. At the fixing nip N in the comparative fixing device 102, the fixing belt 23 rotates while being sandwiched between the pressure roller 24 and the comparative nip formation pad 120; whereas at the fixing nip N in the fixing device 2, the fixing belt 23 rotates while being sandwiched between the pressure roller 24 and the nip formation pad 20. At a circumferential span of the fixing belt 23 other than the fixing nip N, the fixing belt 23 rotates while each axial end portion of the fixing belt 23 is guided by a flange.

The stay 25 is a support disposed inside the loop formed by the fixing belt 23. The stay 25 supports the fixing nip N and the comparative nip formation pad 120 in FIG. 1; whereas the stay 25 supports the fixing nip N and the nip formation pad 20 in FIGS. 2A and 2B. As each of the comparative nip formation pad 120 and the nip formation pad 20 receives pressure from the pressure roller 24, the stay 25 prevents each of the comparative nip formation pad 120 and the nip formation pad 20 from being bent by such pressure, thereby maintaining a uniform width of the fixing nip N in an axial direction of the fixing belt 23. The stay 25 is held and secured by the flanges serving as holders at opposed longitudinal ends of the stay 25, thus being positioned inside each of the comparative fixing device 102 and the fixing device 2. Note that a longitudinal direction of the stay 25 is parallel to the axial direction of the fixing belt 23.

The reflector 27 is interposed between the heater 26 and the stay 25, to reflect the radiation heat from the heater 26 toward the inner circumferential surface of the fixing belt 23. Thus, the reflector 27 prevents the stay 25 from being heated with the radiation heat from the heater 26, for example, thus reducing waste of energy. In a case in which the comparative fixing device 102 or the fixing device 2 excludes the reflector 27, a surface of the stay 25 facing the heater 26 may be insulated or given a mirror finish to reflect the radiation heat from the heater 26 toward the inner circumferential surface of the fixing belt 23.

The fixing belt 23 is an endless belt or film made of a metal material, such as nickel or stainless steel (e.g., steel use stainless or SUS), or a resin material such as polyimide. The fixing belt 23 is constructed of a base layer and a release layer. The release layer, as an outer surface layer of the fixing belt 23, is made of, e.g., perfluoroalkoxy alkane (PFA) or polytetrafluoroethylene (PTFE) to facilitate separation of toner contained in the toner image on the recording medium P from the fixing belt 23. Optionally, an elastic layer made of, e.g., silicone rubber may be interposed between the base layer and the release layer made of, e.g., PFA or PTFE of the fixing belt 23. In a case in which the fixing belt 23 does not incorporate the elastic layer made of, e.g., silicone rubber, the fixing belt 23 has a decreased thermal capacity that improves fixing property of being heated quickly to a desired fixing temperature at which the toner image is fixed onto the recording medium P. However, as the pressure roller 24 and the fixing belt 23 sandwich and press an unfixed toner image onto the recording medium P, slight surface asperities in the fixing belt 23 may be transferred onto the toner image on the recording medium P, resulting in variation in gloss of a solid portion of the toner image. In other words, an orange peel image appears on the recording medium P. The elastic layer made of, e.g., silicone rubber having a thickness not smaller than 100 μm is preferably provided to address such a situation. As the elastic layer made of, e.g., silicone rubber deforms, the elastic layer absorbs the slight surface asperities in the fixing belt 23, thereby preventing formation of the faulty orange peel image.

The pressure roller 24 is constructed of, e.g., a core, an elastic rubber layer resting on the core, and a surface release layer resting on the elastic rubber layer. The release layer, made of PFA or PTFE, facilitates separation of the recording medium P from the pressure roller 24. A driver, such as a motor, is situated inside an image forming apparatus that includes the comparative fixing device 102 or the fixing device 2. A driving force generated by the driver is transmitted to the pressure roller 24 through a gear train, thereby rotating the pressure roller 24. A spring, for example, presses the pressure roller 24 against the comparative nip formation pad 120 in FIG. 1 and the nip formation pad 20 in the FIGS. 2A and 2B, via the fixing belt 23. As the spring presses and deforms the elastic rubber layer of the pressure roller 24, the pressure roller 24 forms the fixing nip N having a given width, which is a given length in the recording medium conveying direction C1. The pressure roller 24 may be a hollow roller or a solid roller. In a case in which the pressure roller 24 is a hollow roller, a heater such as a halogen heater may be disposed inside the hollow roller. The elastic rubber layer may be made of solid rubber. Alternatively, in a case in which no heater is situated inside the pressure roller 24, the elastic rubber layer may be made of sponge rubber. The sponge rubber is preferable to the solid rubber because the sponge rubber has enhanced thermal insulation that draws less heat from the fixing belt 23.

As illustrated in FIG. 1, the comparative nip formation pad 120 of the comparative fixing device 102 includes, a base 121 and a thermal equalizer 122. The comparative nip formation pad 120 has a belt-facing face 120*f* opposite the fixing belt 23 and a nip face 120*n* as part of the belt-facing face 120*f*. The thermal equalizer 122 is disposed in the entire belt-facing face 120*f*, including the nip face 120*n*, of the comparative nip formation pad 120. In a case in which the nip face 120*n* has an uneven irregular shape, the thermal equalizer 122 is made into a desired shape.

However, as the thermal equalizer 122 is made of a metal material, making the thermal equalizer 122 into a desired shape, such as a small R shape, has some difficulties. The thermal equalizer 122 having an irregular shape increases a thermal capacity, leading to a delay in a startup of the comparative fixing device 102.

To address such situations, according to the present embodiment, the fixing device 2 illustrated in FIGS. 2A and 2B includes the fixing belt 23, the heater 26, the nip formation pad 20, and the pressure roller 24. The fixing belt 23 is an endless fixing rotator. The heater 26 is disposed opposite the inner circumferential surface of the fixing belt 23 to heat the fixing belt 23. The nip formation pad 20 is disposed opposite the inner circumferential surface of the fixing belt 23 that is slidable over the nip formation pad 20. The pressure roller 24 is a pressure rotator that presses against the nip formation pad 20 via the fixing belt 23 to form the fixing nip N through which a recording medium P bearing a toner image is conveyed while being sandwiched between the fixing belt 23 and the pressure roller 24. The fixing device 2 fixes the toner image (i.e., unfixed toner image) onto the recording medium P at the fixing nip N. The nip formation pad 20 includes a base 21 and a thermal equalizer 22 having a thermal conductivity higher than a thermal conductivity of the base 21. The nip formation pad 20 has a nip face 20*n* on a fixing nip side. In other words, the nip formation pad 20 has the nip face 20*n* opposite the fixing nip N. The thermal equalizer 22 is disposed in at least part of the nip face 20*n*.

In the nip formation pad 20 of the fixing device 2 according to the present embodiment, the thermal equalizer 22 having an enhanced or increased thermal conductivity is disposed at a position to contact the pressure roller 24.

Such positioning of the thermal equalizer 22 enhances thermal equalization in the axial direction of the fixing belt 23 and reduces an increase in temperature at the axial end portions of the fixing belt 23 during conveyance of a small-size recording medium. The base 21, which constructs the nip formation pad 20 together with the thermal equalizer 22, has a decreased thermal conductivity to restrain heat dissipation. Accordingly, the nip formation pad 20 of the present embodiment shortens a startup time of the fixing device 2.

The nip formation pad 20 has a belt-facing face 20*f* opposite the fixing belt 23 (i.e., fixing rotator). The nip face 20*n* is part of the belt-facing face 20*f*. The belt-facing face 20*f* is a continuous surface constructed of a surface of the base 21 and a surface of the thermal equalizer 22.

The base 21, having a thermal conductivity lower than the thermal conductivity of the thermal equalizer 22, is extended from the thermal equalizer 22. The thermal equalizer 22 of the present embodiment has a smaller shape (or volume) than a shape (or volume) of a typical thermal equalizer (e.g., thermal equalizer 122). Thus, the thermal equalizer 22 reduces the thermal capacity of the nip formation pad 20, compared to the thermal capacity of a typical nip formation pad (e.g., comparative nip formation pad 120).

Note that, the area of the thermal equalizer 22 greater than a nip width, which is a length of the fixing nip N in the recording medium conveying direction C1, eliminates a surface step in a fixing nip area (or an area of the fixing nip N) having a relatively high sliding resistance (i.e., a minute step generated at a connection part between the base 21 and the thermal equalizer 22). The thermal equalizer 22 is preferably disposed in an area greater than the area of the fixing nip N that is formed between the fixing belt 23 and the pressure roller 24 in contact with each other.

The belt-facing face 20*f* of the nip formation pad 20 applied with a lubricant such as fluorine grease or silicone oil reduces a sliding torque.

The nip formation pad 20 is preferably constructed of the base 21 made of resin and the thermal equalizer 22 made of metal having an enhanced or increased thermal conductivity.

The base 21 is preferably made of a heat resistant resin such as liquid crystal polymer, polyimide, polyamide imide, polyphenylene sulfide (PPS), or polyethylene terephthalate (PET).

The thermal equalizer 22 is preferably made of a metal material that is enhanced in both thermal conductivity and strength, such as copper, aluminum, or silver.

As described above, the nip formation pad 20 has the belt-facing face 20*f* opposite the fixing belt 23. The nip face 20*n* is part of the belt-facing face 20*f*. In the example illustrated in FIG. 2B, the belt-facing face 20*f*, including the nip face 20*n*, of the nip formation pad 20 includes a flat portion and a convex portion 20*a*. The flat portion is substantially parallel to the recording medium conveying direction C1. The convex portion 20*a* projects toward the pressure roller 24 on a downstream side of the nip formation pad 20 in the recording medium conveying direction C1. Specifically, the convex portion 20*a* is a part of the base 21.

Such formation of the base 21 facilitates separation of the recording medium P from the fixing belt 23. On the other hand, the thermal equalizer 22 has a flat shape. That is, the thermal equalizer 22 is easily manufactured. Forming the convex portion 20*a* with a resin material is easier than forming the convex portion 20*a* with a metal material.

Since the thermal equalizer 22 is disposed in a limited area to reduce the volume (or thermal capacity) of the thermal equalizer 22, the startup time of the fixing device 2 is shortened. In addition, to enhance the heat equalization in the axial direction of the fixing belt 23, the thermal equalizer 22 may be disposed in the fixing nip area alone of the nip face 20*n*.

Referring now to FIGS. 3A to 3D, a description is given of some variations of the nip formation pad 20.

FIGS. 3A to 3D are cross-sectional views of some variations of the nip formation pad 20.

Figure 3A:
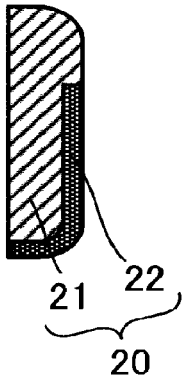
FIG. 3A is a cross-sectional view of a variation of a nip formation pad included in the fixing device of FIG. 2A.
Figure 3B:
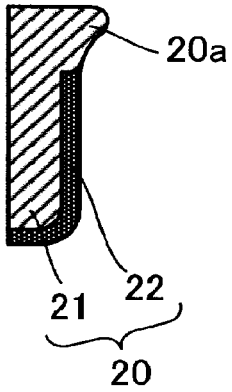
FIG. 3B is a cross-sectional view of a first variation of the nip formation pad included in the fixing device of FIG. 2B.

Specifically, FIG. 3A is a cross-sectional view of a variation of the nip formation pad 20 included in the fixing device 2 of FIG. 2A. FIG. 3B is a cross-sectional view of a first variation of the nip formation pad 20 included in the fixing device 2 of FIG. 2B.

As illustrated in FIGS. 3A and 3B, the thermal equalizer 22 is disposed as an upstream surface of the nip formation pad 20 in the recording medium conveying direction C1. The area in which the thermal equalizer 22 is disposed is designable as appropriate for the model of the image forming apparatus 100 that incorporates the fixing device 2 and the desired thermal capacity. An upstream end portion of the nip formation pad 20 does not affect the separability of the recording medium P from the fixing belt 23. That is, the upstream end portion of the nip formation pad 20 has a simple shape.

Figure 3C:
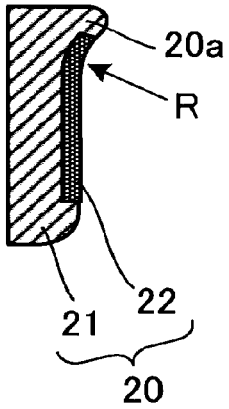
FIG. 3C is a cross-sectional view of a second variation of the nip formation pad included in the fixing device of FIG. 2B.
Figure 3D:
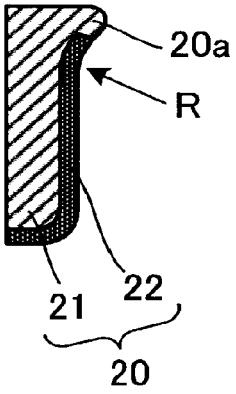
FIG. 3D is a cross-sectional view of a third variation of the nip formation pad included in the fixing device of FIG. 2B.

FIG. 3C is a cross-sectional view of a second variation of the nip formation pad 20 included in the fixing device 2 of FIG. 2B. FIG. 3D is a cross-sectional view of a third variation of the nip formation pad 20 included in the fixing device 2 of FIG. 2B.

To change the pressure exerted at the fixing nip N between the fixing belt 23 and the pressure roller 24, the thermal equalizer 22 may have a deformed portion R (i.e., curved surface) on the nip face 20*n* as illustrated in FIGS. 3C and 3D.

Note that the deformed portion R illustrated in each of FIGS. 3C and 3D has a simpler shape than the shape of the convex portion 20*a* projecting toward the pressure roller 24 on the downstream side of the nip formation pad 20 in the recording medium conveying direction C1. The thermal equalizer 22 with the deformed portion R does not increase the thermal capacity or the startup time of the fixing device 2.

Figure 4:
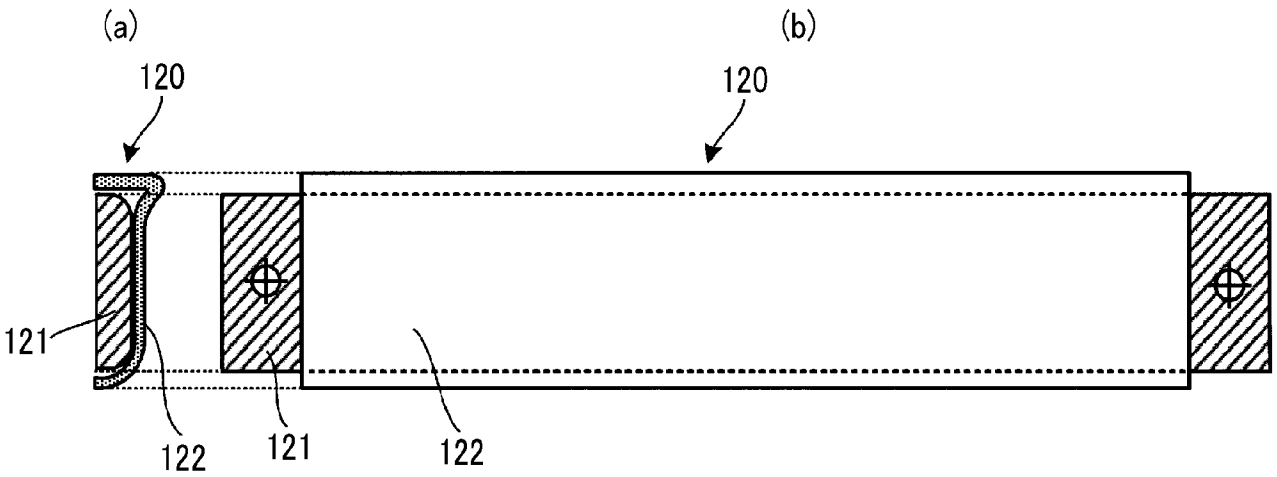
FIG. 4 including FIGS. 4(*a*) and 4(*b*) is a composite side view of a comparative nip formation pad included in the comparative fixing device of FIG. 1.
Figure 5A:
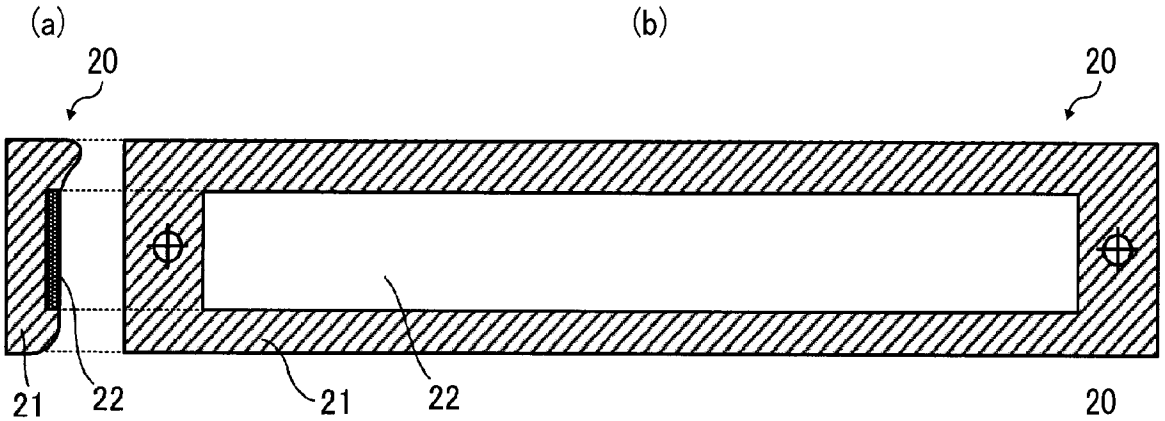
FIG. 5A including FIGS. 5A(a) and 5A(b) is a composite side view of the nip formation pad included in the fixing device of FIG. 2B.
Figure 5B:
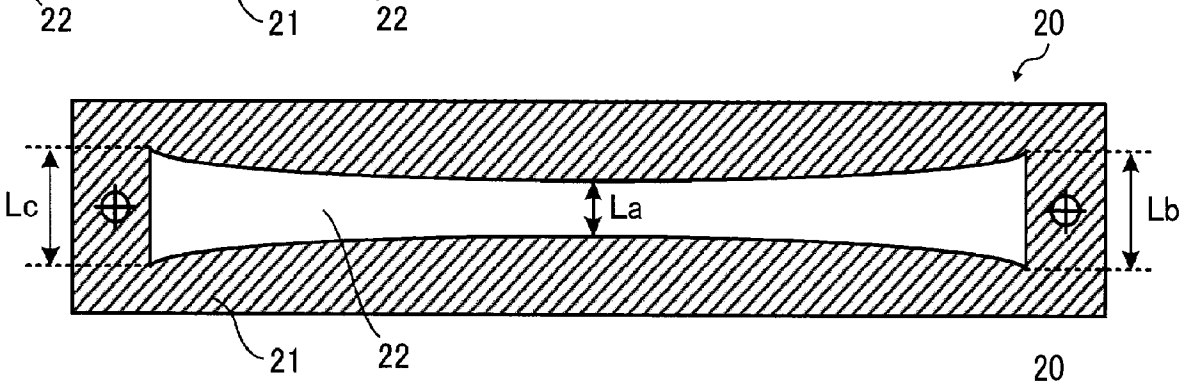
FIG. 5B is a side view of the nip formation pad, particularly illustrating a first variation of a thermal equalizer of FIG. 5A.
Figure 5C:
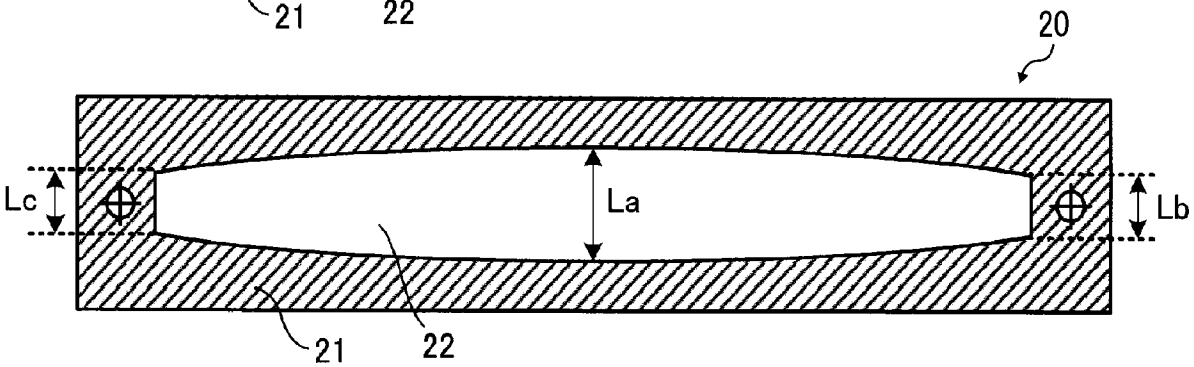
FIG. 5C is another side view of the nip formation pad, particularly illustrating a second variation of the thermal equalizer of FIG. 5A.

Referring now to FIGS. 4 to 5C, a description is given of comparison of the comparative nip formation pad 120 and the nip formation pad 20.

FIG. 4 is a composite side view of the comparative nip formation pad 120 included in the comparative fixing device 102 of FIG. 1.

Specifically, FIG. 4 illustrates a longitudinal end portion of the comparative nip formation pad 120 in section FIG. 4(*a*) and a side portion of the comparative nip formation pad 120 viewed from the pressure roller 24 in section FIG. 4(*b*). Note that a longitudinal direction of the comparative nip formation pad 120 is parallel to the axial direction of the fixing belt 23.

FIGS. 5A to 5C illustrate examples or variations of the nip formation pad 20 according to the present embodiment.

Specifically, FIG. 5A is a composite side view of the nip formation pad 20 included in the fixing device 2 of FIG. 2B. More specifically, FIG. 5A illustrates a longitudinal end portion of the nip formation pad 20 in section FIG. 5A(a) and a side portion of the nip formation pad 20 viewed from the pressure roller 24 in section FIG. 5A(b). Note that a longitudinal direction of the nip formation pad 20 is parallel to the axial direction of the fixing belt 23. FIG. 5B is a side view of the nip formation pad 20, particularly illustrating a first variation of the thermal equalizer 22 of FIG. 5A. FIG. 5C is another side view of the nip formation pad 20, particularly illustrating a second variation of the thermal equalizer 22 of FIG. 5A.

In FIGS. 4 to 5C, a vertical direction is a direction along the recording medium conveying direction C1 (hereinafter, occasionally referred to as a rotational direction); whereas a lateral direction is the longitudinal direction of the comparative nip formation pad 120 in FIG. 4 and the nip formation pad 20 in FIGS. 5A to 5C, axially along the fixing belt 23. Hereinafter, the respective longitudinal directions of the comparative nip formation pad 120 and the nip formation pad 20 may be simply referred to as axial directions.

In the comparative nip formation pad 120 as illustrated in FIG. 4, the thermal equalizer 122 covers the base 121 as a whole in the rotational direction. That is, the thermal equalizer 122 having a relatively large entire area (or volume) and an increased thermal capacity lengthens a startup time of the comparative fixing device 102.

On the other hand, according to the present embodiment as illustrated in FIGS. 5A to 5C, the thermal equalizer 22 is disposed in at least part of the nip face 20*n* of the nip formation pad 20 in the fixing device 2.

The plate-like thermal equalizer 22 facilitates a change in shape, including a width in the axial direction and the rotational direction, as appropriate.

For example, as illustrated in FIGS. 5B and 5C, the thermal equalizer 22 may be shaped such that a length of the thermal equalizer 22 in the recording medium conveying direction C1 (i.e., width of the thermal equalizer 22 in the rotational direction) at a longitudinal center portion of the thermal equalizer 22 axially along the fixing belt 23 differs from the length of the thermal equalizer 22 in the recording medium conveying direction C1 at longitudinal end portions of the thermal equalizer 22 axially along the fixing belt 23.

Specifically, as illustrated in FIG. 5C, the thermal equalizer 22 may be shaped satisfying relations of La>Lb and La>Lc, where La represents the length of the thermal equalizer 22 in the recording medium conveying direction C1 at the longitudinal center portion of the thermal equalizer 22, Lb represents the length of the thermal equalizer 22 in the recording medium conveying direction C1 at one of the longitudinal end portions of the thermal equalizer 22, and Lc represents the length of the thermal equalizer 22 in the recording medium conveying direction C1 at another one of the longitudinal end portions of the thermal equalizer 22.

Thus, the thermal equalizer 22 having the longitudinal end portions shorter in the recording medium conveying direction C1 (i.e., narrower in the rotational direction) than the longitudinal center portion decreases the thermal capacity of the longitudinal end portions of thermal equalizer 22. Accordingly, the thermal equalizer 22 prevents a temperature decrease at the axial end portions of the fixing belt 23 upon a startup of the fixing device 2 and right after the startup of the fixing device 2.

On the other hand, as illustrated in FIG. 5B, the thermal equalizer 22 may be shaped satisfying relations of La<Lb and La<Lc, where La represents the length of the thermal equalizer 22 in the recording medium conveying direction C1 at the longitudinal center portion of the thermal equalizer 22, Lb represents the length of the thermal equalizer 22 in the recording medium conveying direction C1 at the one of the longitudinal end portions of the thermal equalizer 22, and Lc represents the length of the thermal equalizer 22 in the recording medium conveying direction C1 at the other one of the longitudinal end portions of the thermal equalizer 22.

Thus, the thermal equalizer 22 having the longitudinal end portions longer in the recording medium conveying direction C1 (i.e., wider in the rotational direction) than the longitudinal center portion increases the thermal capacity of the longitudinal end portions of thermal equalizer 22. Accordingly, the thermal equalizer 22 prevents a localized temperature increase at the axial end portions of the fixing belt 23.

The lengths Lb and Lc illustrated in FIGS. 5B and 5C may be different from each other, resulting in different thermal capacities at the longitudinal end portions of the thermal equalizer 22. Such a case allows, for example, correction of a thermal deviation due to, e.g., influences of the airflow in the fixing device 2.

Thus, the shape and the width of the thermal equalizer 22 in the rotational direction is designable and selectable as appropriate for the characteristics and the model of the image forming apparatus 100 that incorporates the fixing device 2.

As described above, according to the present embodiment, the fixing device 2 exhibits a quick startup, restrains uneven temperature in the axial direction of the fixing belt 23, and satisfies a separation performance with a simple configuration.

Figure 6:
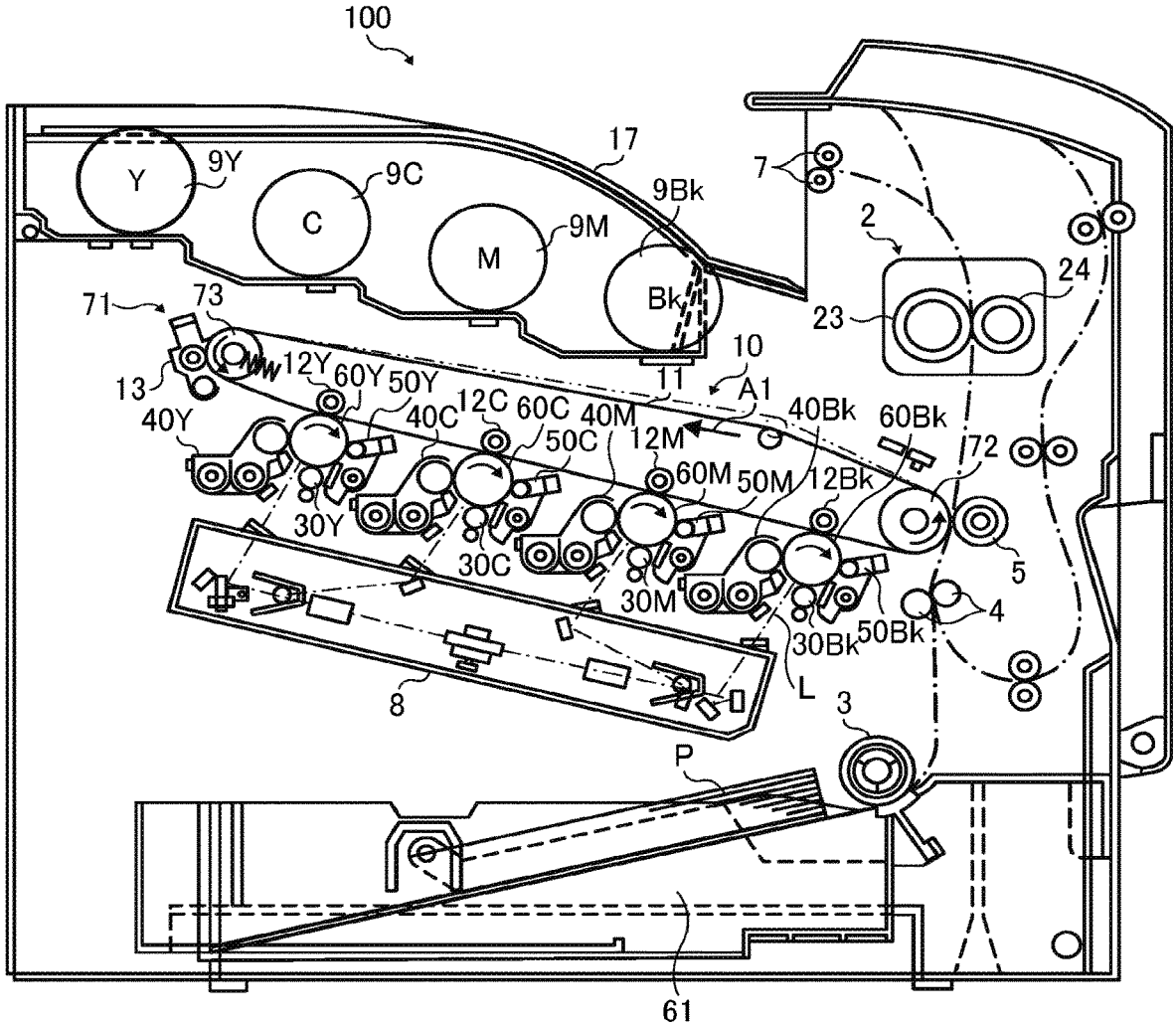
FIG. 6 is a schematic view of an image forming apparatus according to an embodiment of the present disclosure.

Referring now to FIG. 6, a description is given of the image forming apparatus 100 incorporating the fixing device 2 according to the present embodiment described above.

FIG. 6 is a schematic view of the image forming apparatus 100.

As illustrated in FIG. 6, the image forming apparatus 100 is a color printer employing a tandem system in which a plurality of image forming devices for forming toner images in a plurality of colors, respectively, is aligned in a direction in which a transfer belt is stretched and rotates.

Alternatively, the image forming apparatus 100 may employ other structures. The image forming apparatus 100 illustrated in FIG. 6 forms color and monochrome images on recording media by electrophotography. Alternatively, the image forming apparatus 100 may be a monochrome printer that forms monochrome images on recording media. Although FIG. 6 illustrates the image forming apparatus 100 as a color printer, the image forming apparatus 100 may be, e.g., a copier, a facsimile machine, or a multifunction peripheral (MFP) having at least two of printing, copying, scanning, facsimile, and plotter functions.

As illustrated in FIG. 6, the image forming apparatus 100 employs a tandem structure in which four drum-shaped photoconductors 60Y, 60C, 60M, and 60Bk are arranged side by side as image bearers that bear yellow, cyan, magenta, and black toner images in separation colors, respectively.

The image forming apparatus 100 includes a transfer belt 11, which is an endless belt serving as an intermediate transferor rotatable in a direction of rotation Al while facing the photoconductors 60Y, 60C, 60M, and 60Bk. In a primary transfer process, the yellow, cyan, magenta, and black toner images formed as visible images on the photoconductors 60Y, 60C, 60M, and 60Bk, respectively, are transferred successively onto the transfer belt 11 as the transfer belt 11 rotates in the direction of rotation Al in FIG. 1. Specifically, in the primary transfer process, the yellow, cyan, magenta, and black toner images are superimposed one atop another on the transfer belt 11, thus being transferred onto the transfer belt 11. Thereafter, in a secondary transfer process, the yellow, cyan, magenta, and black toner images are transferred at once onto a recording medium P, such as a recording sheet, from the transfer belt 11.

Each of the photoconductors 60Y, 60C, 60M, and 60Bk is surrounded by various pieces of equipment to form a toner image in accordance with rotation of each of the photoconductors 60Y, 60C, 60M, and 60Bk. Specifically, for example, the photoconductor 60Bk is surrounded by a charger 30Bk, a developing device 40Bk, a primary transfer roller 12Bk, and a cleaner 50Bk in this order along a direction of rotation of the photoconductor 60Bk. A black toner image is formed on the photoconductor 60Bk while the photoconductor 60Bk rotates. Like the photoconductor 60Bk, the photoconductors 60Y, 60C, and 60M are surrounded by chargers 30Y, 30C, and 30M, developing devices 40Y, 40C, and 40M, primary transfer rollers 12Y, 12C, and 12M, and cleaners 50Y, 50C, and 50M in this order along a direction of rotation of the photoconductors 60Y, 60C, and 60M, respectively. After the chargers 30Y, 30C, 30M, and 30Bk charges the respective photoconductors 60Y, 60C, 60M, and 60Bk, an optical writing device 8 writes electrostatic latent images on the photoconductors 60Y, 60C, 60M, and 60Bk with laser beams L, respectively.

As the transfer belt 11 rotates in the direction of rotation Al, the yellow, cyan, magenta, and black toner images formed as visible images on the photoconductors 60Y, 60C, 60M, and 60Bk, respectively, are primarily transferred onto the transfer belt 11 such that the yellow, cyan, magenta, and black toner images are superimposed one atop another on the transfer belt 11. In the primary transfer process, the primary transfer rollers 12Y, 12C, 12M, and 12Bk disposed opposite the photoconductors 60Y, 60C, 60M, and 60Bk via the transfer belt 11, respectively, apply a primary transfer bias to the photoconductors 60Y, 60C, 60M, and 60Bk to transfer the yellow, cyan, magenta, and black toner images onto the transfer belt 11 in this order from an upstream side to a downstream side in the direction of rotation Al of the transfer belt 11.

That is, the photoconductors 60Y, 60C, 60M, and 60Bk are aligned in this order from the upstream side in the direction of rotation Al of the transfer belt 11. The photoconductors 60Y, 60C, 60M, and 60Bk are located in four image forming stations that form the yellow, cyan, magenta, and black toner images, respectively.

In other words, the image forming apparatus 100 includes the four image forming stations that form the yellow, cyan, magenta, and black toner images, respectively. In addition, the image forming apparatus 100 includes a transfer belt unit 10, a secondary transfer roller 5, a transfer belt cleaner 13, and the optical writing device 8. The transfer belt unit 10 is situated above and opposite the photoconductors 60Y, 60C, 60M, and 60Bk. The transfer belt unit 10 includes the transfer belt 11 and the primary transfer rollers 12Y, 12C, 12M, and 12Bk. The secondary transfer roller 5 is disposed opposite the transfer belt 11 and rotated in accordance with rotation of the transfer belt 11. The transfer belt cleaner 13 is disposed opposite the transfer belt 11 to clean the transfer belt 11. The optical writing device 8 is disposed below and opposite the four image forming stations.

The optical writing device 8 includes, e.g., a semiconductor laser serving as a light source, a coupling lens, an fθ lens, a toroidal lens, a deflection mirror, and a rotatable polygon mirror serving as a deflector. According to image data of yellow, cyan, magenta, and black, the optical writing device 8 emits the laser beams L to the photoconductors 60Y, 60C, 60M, and 60Bk to form electrostatic latent images on the photoconductors 60Y, 60C, 60M, and 60Bk, respectively. FIG. 6 illustrates the light beam L irradiating the photoconductor 60Bk. Similarly, the light beams L irradiate the photoconductors 60Y, 60C, and 60M, respectively.

The image forming apparatus 100 further includes a sheet feeding device 61 and a registration roller pair 4. The sheet feeding device 61 includes a sheet tray that loads a plurality of recording media P, which is conveyed one by one to an area of contact, herein referred to as a secondary transfer nip, formed between the transfer belt 11 and the secondary transfer roller 5. Activation of the registration roller pair 4 is timed to feed a recording medium P conveyed from the sheet feeding device 61 to the secondary transfer nip formed between the transfer belt 11 and the secondary transfer roller 5 such that the recording medium P meets the yellow, cyan, magenta, and black toner images on the transfer belt 11 at the secondary transfer nip. The image forming apparatus 100 further includes a sensor to detect that a leading end of the recording medium P reaches the registration roller pair 4.

The image forming apparatus 100 further includes the fixing device 2 described above, a sheet ejection roller pair 7, an output tray 17, and toner bottles 9Y, 9C, 9M, and 9Bk. The fixing device 2 is a fusing unit that fixes a composite color toner image, constructed of the yellow, cyan, magenta, and black toner images transferred, onto the recording medium P.

The sheet ejection roller pair 7 ejects the recording medium P bearing the fixed toner image outside a housing of the image forming apparatus 100. The output tray 17 is disposed atop the housing of the image forming apparatus 100. The recording medium P is ejected onto the output tray 17 outside the housing of the image forming apparatus 100 by the sheet ejection roller pair 7. The toner bottles 9Y, 9C, 9M, and 9Bk are situated below the output tray 17. The toner bottles 9Y, 9C, 9M, and 9Bk are replenished with fresh toner of yellow, cyan, magenta, and black, respectively.

In addition to the transfer belt 11 and the primary transfer rollers 12Y, 12C, 12M, and 12Bk, the transfer belt unit 10 includes a driving roller 72 and a driven roller 73. The transfer belt 11 is entrained around the driving roller 72 and the driven roller 73.

A biasing member, such as a spring, biases the driven roller 73 against the transfer belt 11. With such a configuration, the driven roller 73 serves as a tension applicator that applies tension to the transfer belt 11. The transfer belt unit 10, the secondary transfer roller 5, and the transfer belt cleaner 13 together construct a transfer device 71.

The sheet feeding device 61 is disposed in a lower portion of the housing of the image forming apparatus 100. The sheet feeding device 61 includes a sheet feeding roller 3 that contacts an upper surface of an uppermost recording medium P of the plurality of recording media P loaded on the sheet tray of the sheet feeding device 61. As the sheet feeding roller 3 is rotated counterclockwise in FIG. 6, the sheet feeding roller63 feeds the uppermost recording medium P toward the registration roller pair 4.

The transfer belt cleaner 13 of the transfer device 71 includes a cleaning brush and a cleaning blade disposed so as to face and contact the transfer belt 11. With the cleaning brush and the cleaning blade, the transfer belt cleaner 13 scrapes extraneous matter such as residual toner off the transfer belt 11, thereby removing the extraneous matter from the transfer belt 11. Thus, the transfer belt cleaner 13 cleans the transfer belt 11.

The transfer belt cleaner 13 further includes a waste toner conveyor that conveys and discards the residual toner removed from the transfer belt 11.

According to the embodiments described above, the fixing belt 23 serves as a fixing rotator. Alternatively, a fixing film, a fixing sleeve, or the like may be used as a fixing rotator. Further, the pressure roller 24 serves as a pressure rotator. Alternatively, a pressure belt or the like may be used as a pressure rotator.

The embodiments of the present disclosure shorten a startup time of a fixing device.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. A fixing device, comprising:

an endless fixing rotator;

a heater disposed opposite an inner circumferential surface of the fixing rotator to heat the fixing rotator;

a nip formation pad disposed opposite the inner circumferential surface of the fixing rotator that is slidable over the nip formation pad; and a pressure rotator configured to press against the nip formation pad via the fixing rotator to form a fixing nip through which a recording medium bearing a toner image is conveyed while being sandwiched between the fixing rotator and the pressure rotator, wherein the nip formation pad includes a base, and a thermal equalizer having a thermal conductivity higher than a thermal conductivity of the base, the nip formation pad has a nip face opposite the fixing nip, and the nip face faces the fixing rotator, the thermal equalizer is disposed in at least part of the nip face, and a length of the thermal equalizer in a direction of conveyance of the recording medium at a longitudinal center portion of the thermal equalizer axially along the fixing rotator differs from lengths of the thermal equalizer in the direction of conveyance of the recording medium at longitudinal end portions of the thermal equalizer axially along the fixing rotator.

2. The fixing device according to claim 1, wherein the nip formation pad has a belt-facing face opposite the fixing rotator, wherein the nip face is part of the belt-facing face, and wherein the belt-facing face is a continuous surface constructed of a surface of the base and a surface of the thermal equalizer.

3. The fixing device of claim 2, wherein the belt-facing face is further constructed of another surface of the base.

4. The fixing device according to claim 1, wherein the thermal equalizer is disposed in an area greater than an area of the fixing nip formed between the fixing rotator and the pressure rotator in contact with each other.

5. The fixing device according to claim 1, wherein relations of La>Lb and La>Lc are satisfied, where La represents the length of the thermal equalizer in the direction of conveyance of the recording medium at the longitudinal center portion of the thermal equalizer, Lb represents the length of the thermal equalizer in the direction of conveyance of the recording medium at one of the longitudinal end portions of the thermal equalizer, and Lc represents the length of the thermal equalizer in the direction of conveyance of the recording medium at another one of the longitudinal end portions of the thermal equalizer.

6. The fixing device according to claim 1, wherein relations of La<Lb and La<Lc are satisfied, where La represents the length of the thermal equalizer in the direction of conveyance of the recording medium at the longitudinal center portion of the thermal equalizer, Lb represents the length of the thermal equalizer in the direction of conveyance of the recording medium at one of the longitudinal end portions of the thermal equalizer, and Lc represents the length of the thermal equalizer in the direction of conveyance of the recording medium at another one of the longitudinal end portions of the thermal equalizer.

7. The fixing device according to claim 1, wherein the base is made of resin, and wherein the thermal equalizer is made of metal having an increased thermal conductivity.

8. The fixing device according to claim 1, wherein the nip formation pad has a belt-facing face opposite the fixing rotator, wherein the nip face is part of the belt-facing face, wherein the belt-facing face includes:

a flat portion substantially parallel to a direction of conveyance of the recording medium; and a convex portion projecting toward the pressure rotator on a downstream side of the nip formation pad in the direction of conveyance of the recording medium, and wherein the convex portion is a part of the base.

9. An image forming apparatus comprising:

an image bearer configured to bear a toner image; and the fixing device according to claim 1, the fixing device being configured to fix the toner image onto the recording medium.

* * * * *